US007000520B2

(12) United States Patent
Nichols et al.

(10) Patent No.: US 7,000,520 B2
(45) Date of Patent: Feb. 21, 2006

(54) ROLL SUPPORTING SLIDE CUTTER ASSEMBLY INCORPORATING A TRAVERSABLE CUTTER TAB AND IN PARTICULAR CAPABLE OF BEING SUPPORTED WITHIN A CARTON ENCLOSURE ASSOCIATED WITH A WRAP MATERIAL ROLL

(75) Inventors: Monica Stautner Nichols, Richmond, VA (US); William H. Grassel, Delmont, PA (US); G. Douglas Powell, Richmond, VA (US); Richard W. Rider, Midlothian, VA (US); Jeffrey M. Shoup, Delmont, PA (US); Jean Ann Skiles, Gibsonia, PA (US); Robert J. Speer, Upper Burrell, PA (US); Frank R. Micle, Irwin, PA (US); David Plank, Export, PA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 10/460,953

(22) Filed: Jun. 12, 2003

(65) Prior Publication Data

US 2004/0040429 A1 Mar. 4, 2004

Related U.S. Application Data

(60) Provisional application No. 60/423,543, filed on Nov. 4, 2002, provisional application No. 60/414,159, filed on Sep. 27, 2002, provisional application No. 60/401,683, filed on Aug. 6, 2002, provisional application No. 60/397,961, filed on Jul. 23, 2002, provisional application No. 60/388,038, filed on Jun. 12, 2002.

(51) Int. Cl.
*B26D 1/04* (2006.01)
*B65H 75/32* (2006.01)

(52) U.S. Cl. ..... 83/578; 83/614; 83/649; 83/949; 225/47

(58) Field of Classification Search ..... 83/56, 83/578, 614, 649, 454, 455, 636, 922, 949, 83/929; 225/46, 47, 56, 65, 66, 77, 25, 26
See application file for complete search history.

(56) References Cited

U.S. PATENT DOCUMENTS 2,250,236 A 7/1941 Russell ..... 206/58

(Continued)

FOREIGN PATENT DOCUMENTS

| | | |
|---|---|---|
| CN | 2279695 Y | 4/1998 |
| CN | 1348916 A | 5/2002 |
| JP | 3-7342 | 1/1991 |
| JP | 11-33980 | 2/1999 |
| JP | 2002308283 | 10/2002 |
| WO | WO 01/45911 | 6/2001 |

*Primary Examiner*—Clark F. Dexter
(74) *Attorney, Agent, or Firm*—Daniel P. Cillo; Robert A. Diaz; Eckert Seamans Cherin & Mellott, LLC

(57) ABSTRACT

A slide cutter assembly for use in sectioning lengths of a packaging material drawn from a roll. The device includes an elongated and shaped body. A first roll supporting portion is located at a first end of said body and a second roll supporting portion is likewise located at a second end of the body. A cutter assembly extends from a selected lengthwise extending edge of the body and upon which an unwound length of the packaging material comes into contact. The cutter assembly incorporates a traversable blade for sectioning from the roll the length of packaging material. The roll of packaging typically comes in a generally elongated and three-dimensional shaped packaging, the cutter device being constructed so that it may be supported within an interior defined by the packaging and upon first mounting the roll between the first and second roll supporting portions.

16 Claims, 7 Drawing Sheets

U.S. PATENT DOCUMENTS 2,420,460 A 5/1947 Bowdoin et al. ..... 164/73
2,743,009 A 4/1956 Williamson et al. ..... 206/58
2,806,529 A 9/1957 Bulman ..... 164/84.5
3,142,426 A 7/1964 Busse ..... 225/43
3,199,394 A 8/1965 Castelli ..... 83/578
3,222,972 A 12/1965 Fulton ..... 83/564
3,370,497 A 2/1968 Busse ..... 83/455
3,549,066 A 12/1970 Wankow ..... 225/25
3,679,110 A 7/1972 Stine ..... 225/47
3,688,625 A 9/1972 Thomas et al. ..... 83/614
3,748,939 A 7/1973 Feinstein et al. ..... 83/370
3,821,915 A 7/1974 Larrable ..... 83/174
3,845,894 A 11/1974 Merlin ..... 225/25
3,974,947 A 8/1976 Budny ..... 225/25
3,981,215 A 9/1976 Granger et al. ..... 83/455
3,986,419 A 10/1976 Cleghorn ..... 83/174
4,020,550 A 5/1977 Okada ..... 30/124
4,156,382 A 5/1979 Baker ..... 93/33
4,197,774 A 4/1980 Singh et al. ..... 83/374
4,210,043 A 7/1980 Urion et al. ..... 83/175
4,245,536 A 1/1981 Urion ..... 83/821
4,307,828 A 12/1981 Sias et al. ..... 225/25
4,474,318 A 10/1984 Perrin ..... 225/50
4,534,497 A 8/1985 Neale ..... 225/25
4,582,234 A 4/1986 Marcoux ..... 225/48
4,648,536 A 3/1987 VanderLugt ..... 225/43
4,666,072 A 5/1987 McCarter ..... 225/25
4,679,718 A 7/1987 Kai et al. ..... 225/48
4,754,674 A 7/1988 Perlman ..... 83/422
4,762,042 A 8/1988 Denter et al. ..... 83/374
4,779,780 A 10/1988 Scharf ..... 225/42
4,787,284 A 11/1988 Chen ..... 83/614
4,817,483 A 4/1989 Armbruster ..... 83/488
4,957,023 A 9/1990 Chen ..... 83/372
4,960,022 A 10/1990 Chuang ..... 83/175
5,007,319 A 4/1991 Armbruster ..... 83/488
5,025,692 A 6/1991 Reynolds ..... 83/468
5,036,740 A 8/1991 Tsai ..... 83/455
5,044,241 A 9/1991 Labrecque ..... 83/489
5,050,788 A 9/1991 Taguchi et al. ..... 225/25
5,107,734 A 4/1992 Armbruster ..... 83/205
5,186,091 A 2/1993 Wolf ..... 83/649
5,186,376 A 2/1993 Scharf et al. ..... 225/42
5,222,644 A 6/1993 Moreno ..... 225/19
5,243,890 A 9/1993 Ober ..... 83/471.2
5,275,321 A 1/1994 Manu et al. ..... 225/45
5,292,046 A 3/1994 Kaiser et al. ..... 225/19
5,398,576 A 3/1995 Chin ..... 83/614
5,440,961 A 8/1995 Lucas, Jr. et al. ..... 83/455
5,524,515 A * 6/1996 Boda ..... 83/455
5,620,128 A 4/1997 Dingman et al. ..... 225/19
5,732,868 A 3/1998 Gammon, Jr. ..... 225/48
5,758,559 A 6/1998 Capitao, Jr. et al. ..... 83/614
5,768,968 A 6/1998 Park et al. ..... 83/614
5,884,763 A 3/1999 Ozawa ..... 206/397
6,105,481 A 8/2000 Schuler ..... 83/578
6,223,639 B1 5/2001 Chen ..... 83/614
6,375,058 B1 4/2002 Passamoni ..... 225/49
2002/0023526 A1 2/2002 Vegliante et al. ..... 83/614
2002/0117038 A1 8/2002 Vegliante et al. ..... 83/578
2004/0007606 A1 1/2004 Baker, Jr. ..... 255/1
2004/0237746 A1 12/2004 Schultz et al. ..... 83/614
2005/0005755 A1 1/2005 Turvey et al. ..... 83/614

* cited by examiner

ROLL SUPPORTING SLIDE CUTTER ASSEMBLY INCORPORATING A TRAVERSABLE CUTTER TAB AND IN PARTICULAR CAPABLE OF BEING SUPPORTED WITHIN A CARTON ENCLOSURE ASSOCIATED WITH A WRAP MATERIAL ROLL

CROSS-REFERENCE TO RELATED APPLICATIONS

The present application claims the priority of U.S. Provisional Application Ser. No. 60/388,038, filed Jun. 12, 2002, and entitled "Insertable Slide Cutter for Use with Wrap and Packaging Materials"; as well as the priority of U.S. Provisional Application Ser. No. 60/397,961, filed Jul. 23, 2002, and entitled "Slide Cutter Assembly Incorporated Into a Container Configuration Which Holds and Dispenses a Roll of Packaging Materials"; as well as the priority of U.S. Provisional Application Ser. No. 60/401,683, filed Aug. 6, 2002, and entitled "Slide Cutter Assembly for Use With a Roll of Packaging Materials"; as well as the priority of U.S. Provisional Application Ser. No. 60/414,159, filed Sep. 27, 2002, and entitled "Slide Cutter Insert Assembly with Configured Cutter Tab"; as well as the priority of U.S. Provisional Application Ser. No. 60/423,543, filed Nov. 4, 2002, and entitled "Slide Cutter Insert Assembly Including Gripping Tabs for Securing Within a Packaging Container Associated with a Roll of Wrap Material as Well as Latching Means for Fixedly Securing Hinged Roll Supporting Ends".

FIELD OF THE INVENTION

The present invention relates generally to slide cutter assemblies for use with severing unreeled sections of wrap material from a roll thereof. More particularly, the present invention discloses such a roll supporting slide cutter assembly incorporating a traversable cutter tab and which is in particular capable of being supported within a conventional carton enclosure associated with the roll of wrap material.

BACKGROUND OF THE INVENTION

The prior art is replete with examples of wrap dispensing and cutting devices, the purpose for which is to cut or section an unwound length of a packaging or covering type material. The most commonplace of such devices are typically provided as generally elongated and rectangular shaped packaging within which is held a suitable roll of material. A shelf edge of the packaging, typically revealed upon pivotally opening an associated lid, includes a serrated knife-edge such that, upon unwinding the desired length of packaging, the wrap may be biased against the knife edge and the unwound section removed.

Shortcomings associated with the conventionally known knife-edged packaging include the incidence of the unwound packaging not severing properly and/or becoming bunched or folded together. With particular regards again to such conventional types of packaging, this can result in the sectioned packaging being substantially rendered useless.

Accordingly, attempts have been made in the relevant art to improve upon the sectioning and removal of such conventional packaging materials. One example of this is illustrated in U.S. Pat. No. 4,957,023, issued to Chen, and which teaches a plastic wrap dispenser with a battery-operated cutting device adapted for cutting a section of thin plastic wrap from the roll. The cutting device is fixed on a mount and is able to be slidably moved along a fixed track by way of a transmission mechanism activated by a battery-powered motor.

A further example of a manually operable sectioning device is taught by U.S. Pat. No. 6,223,639, issued to Chen, and which teaches an aluminum foil safety fixture which utilizes a slide plate for gradually separating the foil. The slide plate includes arched pressing edge, fitted to a push unit installed with at least one pair of slide pressing rollers, and movably assembled in a slide rail associated with a main base unit. A supporting plate extends from the main base unit and a clasp plate can be directly fitted to a wall of the aluminum foil packaging box to facilitate unwinding and sectioning of lengths thereof.

Similar to Chen U.S. Pat. No. 6,223,639, other and additional examples of film cutting devices include U.S. Pat. No. 5,758,559, issued to Capitao, and U.S. Pat. No. 5,440,961, issued to Lucas, Jr., each of which include a track mechanism of some sort mounted in lengthwise extending fashion to an exposed shelf edge of a conventional packaging and including a type of button configured sectioning blade for traversing the length of the track mechanism over which is laid the packaging.

Finally, an additional set of prior art references teach cutter assemblies in which a slide cutter according to some configuration is built into a housing, in turn configured to hold a roll of the wrap material. Examples of such assemblies include those disclosed in U.S. Pat. No. 6,105,481, issued to Schuler, U.S. Pat. No. 4,197,774, issued to Singh et al., and U.S. Pat. No. 4,156,382, issued to Baker.

SUMMARY OF THE INVENTION

The present invention is a slide cutter assembly for use in sectioning lengths of a packaging material drawn from a conventional roll. The slide cutter assembly is also an improvement over prior art devices in that it is capable of supporting the roll of packaging material in secure and rotatable fashion, while at the same time capable of being supported, in a preferred embodiment, within a generally elongated and three-dimensional configuration of a carton-type product packaging associated with the roll of material.

The slide cutter assembly includes an elongated body having a top edge established by a perpendicularly extending film support ledge, a bottom edge, a first end and a second end. First and second roll supporting portions are, in the preferred embodiment, integrally formed with the ends of the elongated body and are each typically interconnected with the main carrier body by means of a flexible and living hinge.

Each of the roll supporting portions also includes a planar base support and a circular cross sectional shaped and extending core support portion. It is further envisioned that the extending core support portions are capable of being configured in any one of a number of different tapered or angled variants, the purpose of which is to facilitate seating within the associated open end of the roll holding the flexible material and such as during pivoting of the roll support portions relative to the main body. Interengaging latch portions establish the roll supporting portions in a substantially 90° angle relative to the extending main body and such that the core support portions are seated within the oppositely extending and open ends of the roll of wrap material upon them being rotated into place.

A cutter assembly extends in lengthwise fashion from an associated upper edge of the main planar shaped body. The cutter assembly is preferably secured in traversable fashion along an associated edge of the elongate main body.

In the preferred embodiment, the cutter assembly includes a blade assembly exhibiting both a gripping portion and a track seating portion, between which is situated first and second angled blade edges. A rail, typically constructed of a coextruded plastic material, is mounted to an upper extending edge of the elongated body, typically by seating elongated and downwardly extending gripping portions associated with the rail upon projecting snap portions associated with the main body. The top surface of the rail may exhibit film attracting properties and in order to assist in drawing upon the rail any type of either electrostatically attracting wrap material (such as again film wrap) or adhesively attracting material, and such as may be accomplished by applying a tacking material.

An axially extending and interior channel is associated with the rail and within which is seated the track seating portion of the cutter assembly. End stops are further associated with the upper edge of the main body and, upon assembly of the rail, prevent inadvertent removal of the cutter tab from the rail. End stop geometry works in conjunction with the cutting tab design to maximize the width of the wrap that can be sectioned for a given slide cutter assembly width and by virtue of permitting the cutting tab to extend partially beyond the associated rail.

In use, the roll of wrap material is mounted in rotatably supporting fashion between the roll supporting portions and such that the flexible material to be withdrawn (plastic wrap, foil, paper, etc.) is arrayed in either an over roll or under roll dispensing condition. It is also a preferred embodiment of the invention that the cutter assembly is capable of being supported within the confines of a conventional, three-dimensional and elongated carton, and with which the roll material is usually initially packaged. Upon withdrawing a desired area (length by width) of the flexible material, the cutter tab is actuated, substantially across the traversable length of the rail, and in order to section the desired area of material from the roll.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF PREFERRED EMBODIMENTS

Figure 1:
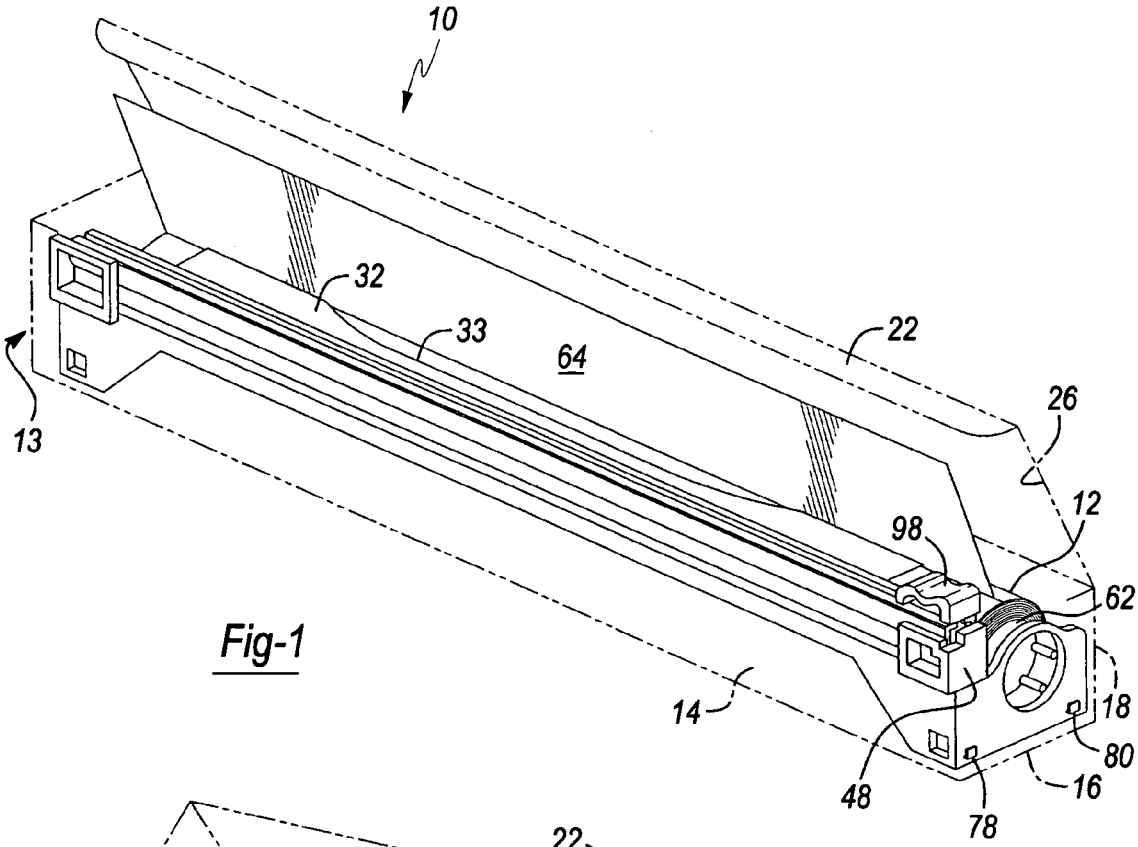
FIG. 1 illustrates a perspective view of the insertable slide cutter assembly in use with a roll of wrap material and supported within a conventional carton according to the present invention.

Referring to FIG. 1, a slide cutter assembly is illustrated at 10 for use in rotatably supporting and sectioning lengths of packaging material associated with a wound roll 12 of such material. As described previously, the present invention is an improvement over prior art devices in that it is capable of supporting the roll of packaging material in secure and rotatable fashion, either in an over dispensing or under dispensing condition, this further being a variable of the direction in which the leading edge of the roll unreels.

Additionally, the slide cutter assembly 10 is capable of functioning alone with the wound roll 12 of packaging material supported thereupon or, alternatively, may be inserted in substantially contained fashion within the generally elongated and three-dimensional configuration of the product packaging. The carton, 13, as shown in phantom at 13 in FIG. 1, includes three elongated and interconnecting sides 14, 16 and 18, a fourth side 20 hingedly connected along side edge 18, such that the fourth side 20 defines a lid and further includes an angled end flap 22. Although not clearly illustrated in FIG. 1, the carton also includes ends, which interconnect with the three elongated sides 14, 16 and 18. To again confirm what has been previously explained, the slide cutter assembly can function either as an insert within the conventional wrap carton or, alternatively, can operate exclusive of the carton and such as further by either mounting the assembly upon any suitable surface or utilizing the assembly in a free standing and supported manner.

Figure 2:
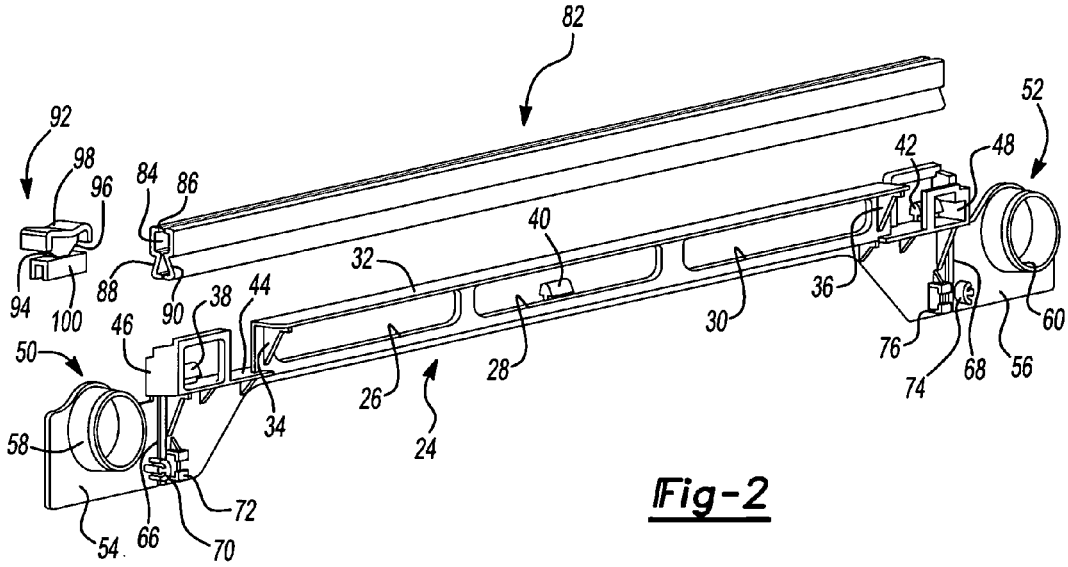
FIG. 2 is an exploded view in perspective of the insertable slide cutter assembly according to FIG. 1 and illustrating the features of the cutting tab, extruded plastic rail and main carrier according to the present invention.

Referring again both to the assembled view of FIG. 1 and the exploded view of FIG. 2, the assembly 10 includes an elongated body, referenced generally at 24 in FIG. 2. The body 24 defines a main portion of the slide cutter assembly and is usually constructed of a suitable and molded material, although it is further understood that other materials can also be utilized within the scope of the invention.

The elongate extending length of the main body may include (without limitation) apertured portions, such as illustrated by inner facing surfaces 26, 28 and 30, and in order to reduce weight and material investment. Additional features include an upper ledge 32, with contoured edge surface 33, typically supported at 34 and 36 (see again FIG. 2) relative the main body, and upwardly projecting snap portions 38, 40 and 42, extending from a base surface 44 (again FIG. 2) of the main body which facilitates installation of an attachable rail atop the base surface 44. Also extending upwardly from the main carrier body 24 are first and second end stops 46 and 48 and which (as will be further described in greater detail) maintain the cutting tab (to be further disclosed) within the cutter assembly, while maximizing the width of film that can be cut for any given slide cutter assembly width.

Figure 3:
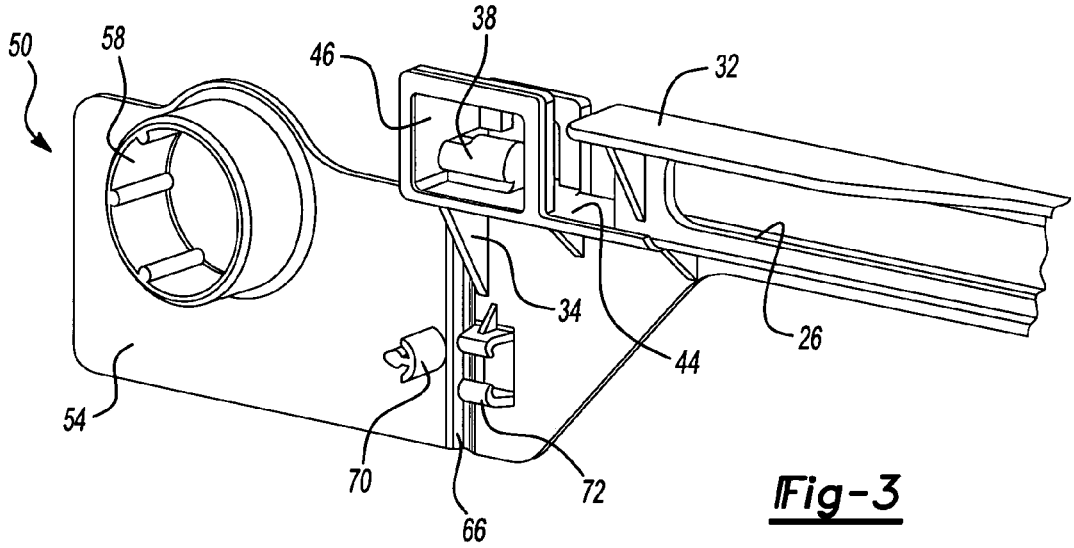
FIG. 3 is a sectional view of a roll supporting spool holder in hinged relationship with the main carrier body and further illustrating the film support ledge of the main carrier in addition to the features of the end stop and rail side supports according to the present invention.

A pair of roll supporting portions are illustrated generally at 50 and 52, see again as best shown in FIG. 2 as well as in FIG. 3, and according to a preferred embodiment of the present invention. Each of the roll supporting portions 50 and 52 includes a planar disposed portion, see at 54 and 56 respectively, as well as a circular cross sectional shaped and projecting core support portion, see at 58 and 60.

As further shown in FIG. 1, a representation of a roll of flexible material is shown and includes oppositely open core ends (see at 62 in FIG. 1) as well as an unreeled area of material, see at 64. As again described previously, the flexible material is most broadly described as including any suitable material capable of being dispensed from a roll, such further including plastic (film) wrap, foil, paper or any other suitable material.

The roll supporting portions 50 and 52 are pivotally secured to the opposite ends of the main body 24 by virtue of living hinges, see at 66 and 68 respectively. First and second pairs of latching portions are associated with each of the first and second roll supporting portions 50 and 52, and such is further illustrated at 70 and 72 for roll supporting portion 50 and at 74 and 76 for roll supporting portion 52.

Each of the latching portions 70 and 74 are constructed according to a first configuration with a male projecting portion and by which they are respectively seated between pairs of spaced apart and biasing members associated with the latching portions 72 and 76. In this fashion, and as is best illustrated in FIG. 1, the roll supporting portions 50 and 52 are rotated inwardly to approximately a 90° angular orientation relative to the main carrier body 24, at which point the projecting core support portions 58 and 60 seat within the oppositely open ends of the roll of material and to thereby rotatably support the roll of material upon the assembly 10. Also shown at 78 and 80 (see FIGS. 1 and 5) are gripping dimples which project from an outer face of each of the planar portions 54 and 56 and which function to assist in mechanically holding the cutter assembly 10 within the conventional carton interior (see again FIG. 1) and during use.

It is further understood that the slide cutter assembly, while preferably being capable of shipped in a substantially flattened condition and such as is permitted by the rotatable roll supporting portions, can also incorporate other suitable roll supporting portions, such as those which are not connected by living hinges, but rather are flexibly connected to the ends of the main carrier body 24, and without the additional need of latching portions, and such that they are already substantially in their perpendicular angular relationship. It is envisioned that, in such an application, the roll supporting ends are simple biasingly flexed to seat over the open core ends of the roll.

As best illustrated in FIG. 2, an elongated rail is generally illustrated at 82. The rail is preferably constructed of an extruded plastic material or materials, such as constructed from an ABS, PVC or other suitable material. It is also contemplated that the rail may be constructed from other materials, either machined, molded or formed by conventional process techniques, and which are contemplated to be within the scope of the present invention. The rail 82 includes, as is best shown in cross section, an interior upper channel 84 communicable with a top surface of the rail by a gap 86, and as well as a pair of downwardly extending and elongated/biasing gripping portions 88 and 90.

Figure 1A:
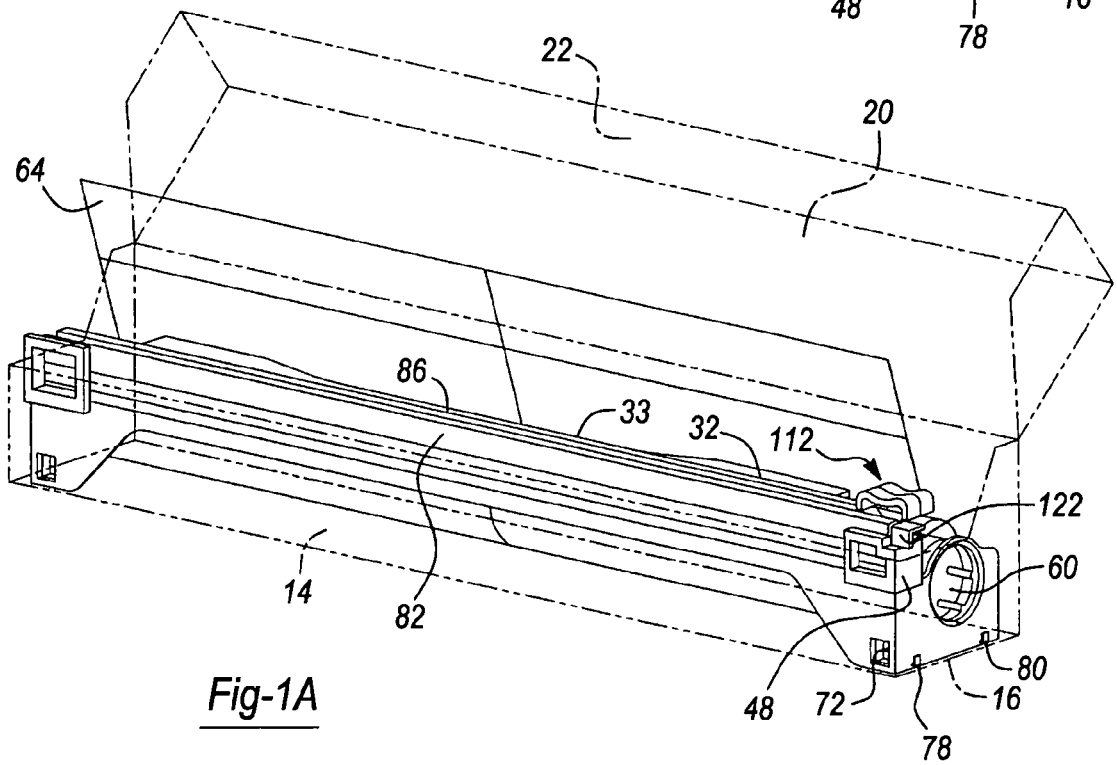
FIG. 1A is a perspective illustration of the slide cutter assembly according to an alternate configuration and which in particular illustrates the manner in which the cutting tab with offset track seating portions is capable of displacing a selected distance beyond an outermost edge of an associated rail support.
Figure 1B:
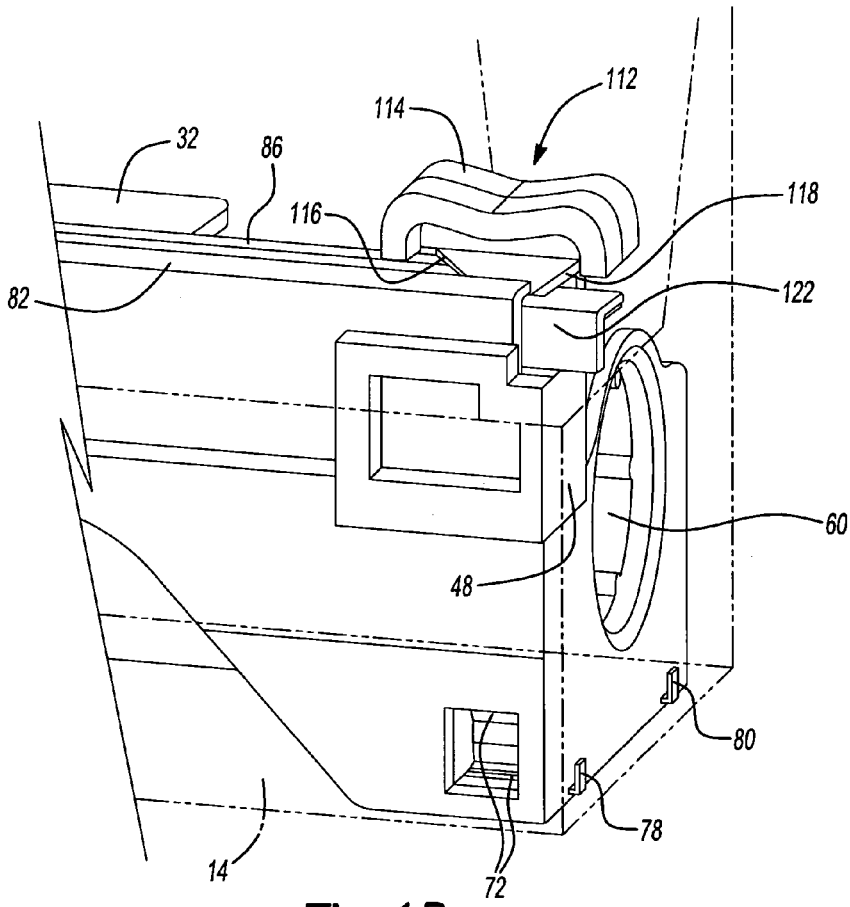
FIG. 1B is an enlarged end view in perspective of the slide cutter assembly illustrated in FIG. 1A.

A cutter assembly is provided in combination with the attachable and elongated rail and such includes the provision of a cutter tab assembly 92 (see again FIG. 2). In a preferred embodiment, the cutting tab 92 includes a stainless steel blade having oppositely angled edges 94 and 96, a first or upper gripping portion 98 (typically ergonomically configured) and a second or lower track seating portion 100, and which is configured for inserting in end fashion within the interior channel 84 of the elongated rail 82. As will be further explained in reference to FIGS. 6A–6C, as well as FIGS. 1A and 1B, the lower track seating portion preferably incorporates offset seating portions in order to enable it to extend a partial end distance beyond an associated rail support. However, and for purposes of FIG. 6 only, it is also understood that the track seating portion can adopt any configuration, such as including a smooth and substantially "U" end sectional shape as illustrated.

The cutter tab blade is constructed so that it lies symmetrical about a vertical centerline established by the tab cutter and thereby so that it, upon being installed within the rail, is traversable in both directions to cut the flexible material. The blade may further be made from other materials such as carbon steel, plastic or any other material that will enable a smooth cut of the product being severed.

In use, the cutter tab 92 is first mounted in its end inserting fashion within the rail 82, the rail then being attached in seating fashion upon the surface 44 of the main carrier body 24 and by biasingly/snappingly engaging the downwardly extending gripping portions 88 and 90 upon the upwardly projecting snap portions 38, 40 and 42 and further such that the rail 82 is rendered more rigid by being secured atop the main carrier body and seated between the closed end stops 46 and 48. The traversable path of the cutter tab 92 is such that it extends a selected distance beyond an end of the unreeled flexible (wrap) material 64 and to facilitate complete cutting of the wrap material in end-to-end fashion.

The top surface of the rail 82, in proximity to the blade traversing gap 86, operates to attract the unreeled surface of the flexible material and in order to facilitate the operation of the cutter tab 92. In particular, the rail may include the application of a tacky surface and which serves to hold such as a film material for cutter, as well as to keep the film at a convenient and consistent location so that it can be acquired for a succeeding cut. The rail may also include the provision of a tacky or, alternately, application of electrostatic attracting properties in order to draw or adhere such as a film wrap layer thereupon. It is also contemplated that the ledge, 32, may also be roughened or otherwise material selected to make it unattractive (non-adhering) to the product being severed.

The plastic portion associated with the cutter tab 92 is further preferably constructed of a High Impact Polystyrene (HIPS) material and in order to provide a safe human interface to the angled surfaces of the cutting blade. Insert molding of the blade within the cutter tab is preferred, but the blade may also be inserted within molded pieces which are then glued, ultrasonically welded, or similarly joined together to secure the blade. Plastic blades may be molded as an integral part of, and at the same time as, the rest of the cutter tab. It is also envisioned that the bottom of the track seating portion 100 of the cutter tab may be designed such that the tab can extend partially past each of the end stops 46 and 48 (see FIG. 6) of the carrier and in an attempt to limit the overall length of the conventional box design.

Figure 4:
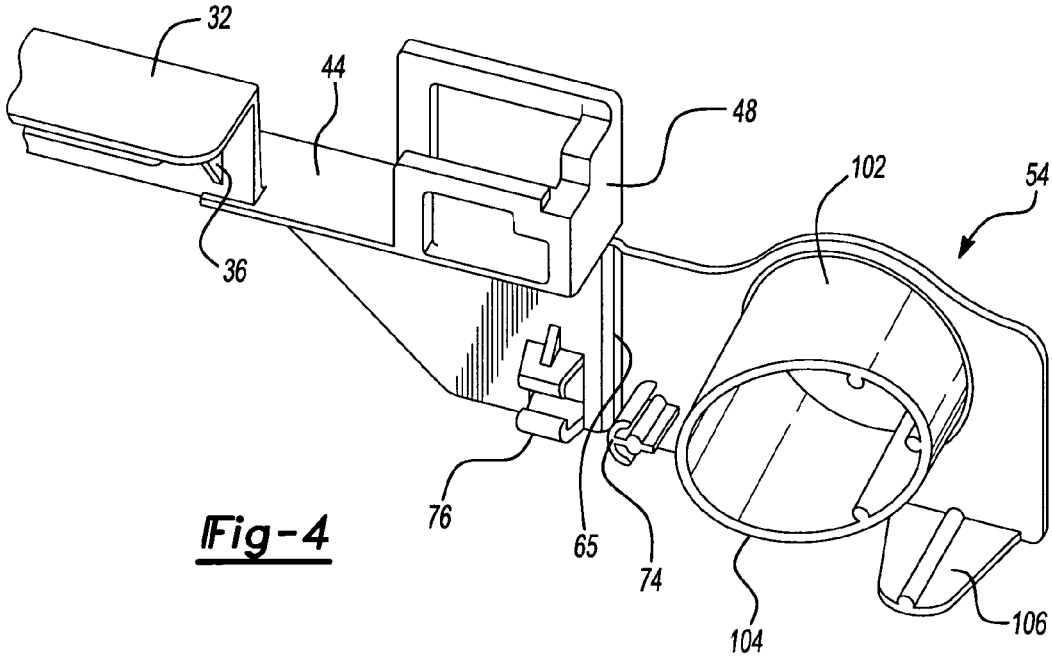
FIG. 4 is a sectional illustration of a variation of the roll supporting portion and main carrier body shown in FIG. 3, and further illustrating the support portion exhibiting an increased length of lead-in edge in order to provide guiding support of the product roll core during the 90° rotation of the support portion relative to the main carrier body.

Referring to FIG. 4, a sectional illustration of a variation of the roll supporting portion and main carrier body previously shown in FIG. 3 is further illustrated. Of note, the circular cross sectional and projecting core support portion 102 exhibits an increasing length lead-in edge (see edge taper 104) in order to provide guiding support of the product roll core during the 90° rotation of the support portion relative to the main carrier body. Also illustrated at 106 in FIG. 4 is a support tab which extends normally from an end face of the planar portions associated with an end supports and which, in the engaged position of FIG. 1, assists in supporting the slide cutter assembly in level fashion, and as the assembly is end loaded into a carton.

Figure 5:
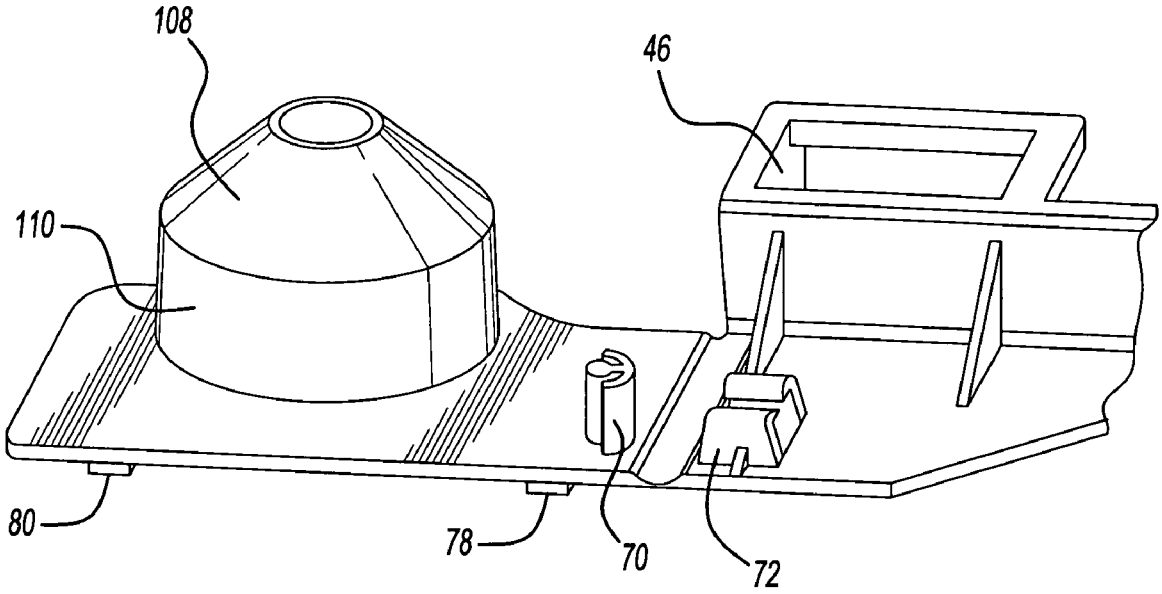
FIG. 5 is a still further variation in sectional illustration of a selected and hinged associated roll support portion, and showing a conical addition to the support portion in order again to provide a guide into the product roll core during the 90° rotation of the support portion relative to the main carrier body.

Referring to FIG. 5, a still further variation in sectional illustration is shown of a selected and hingedly associated roll supporting portion. In particular, and in contrast to the illustrations of either FIG. 3 or 4, FIG. 5 shows a conical addition 108 to an associated and pivotable roll support holder 110 in order again to provide a guide into the product roll core during the 90° rotation of the support portion relative to the main carrier body.

Figure 6:
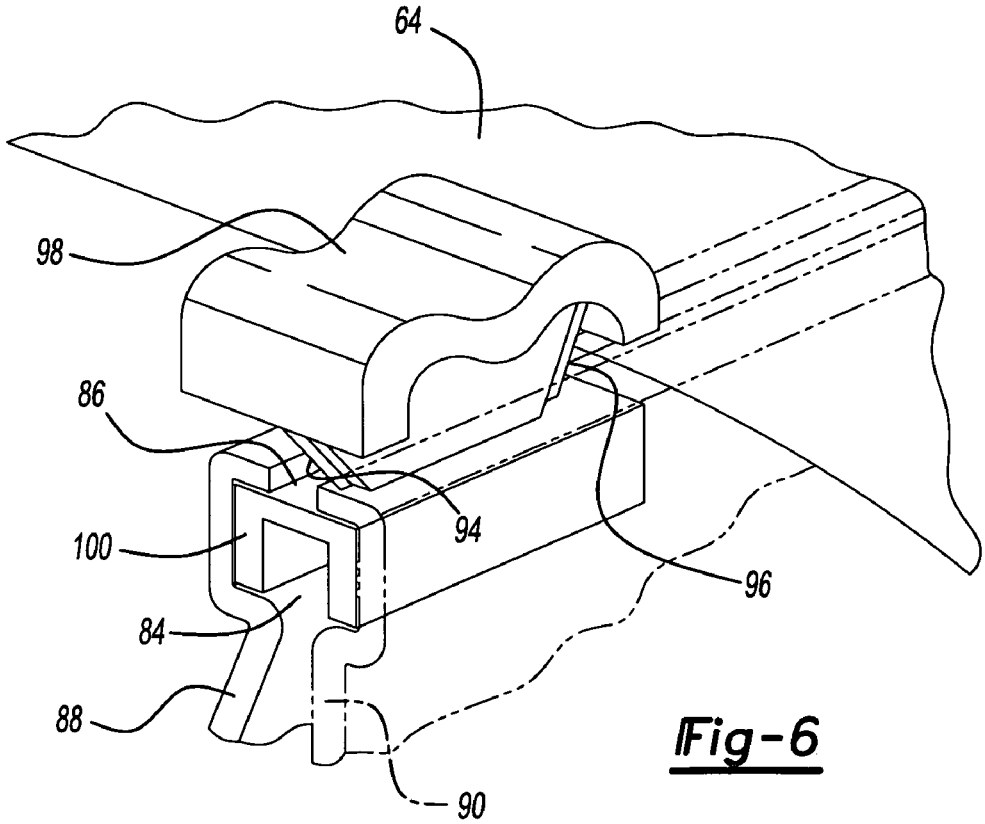
FIG. 6 is a sectional view of the cutter knob mounted in traversable fashion within the co-extruded rail and according to the present invention.
Figure 6A:
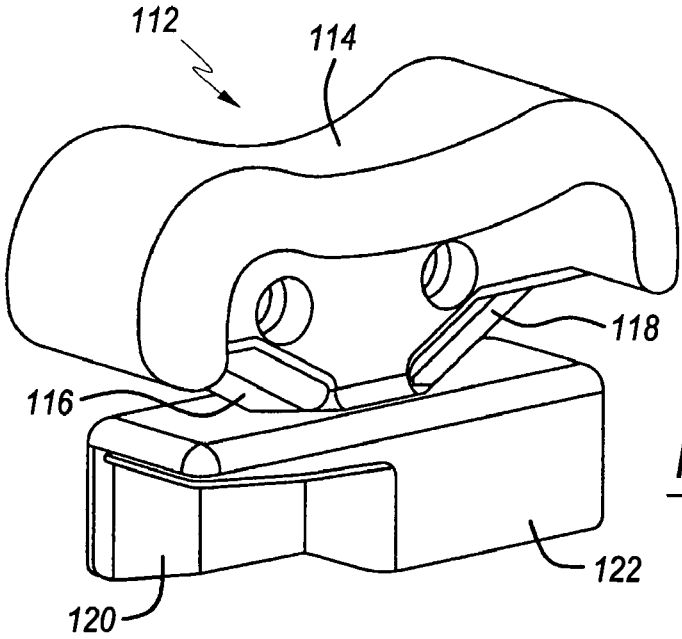
FIG. 6A is a perspective view of a cutter tab according to a modified variant of the present invention.
Figure 6B:
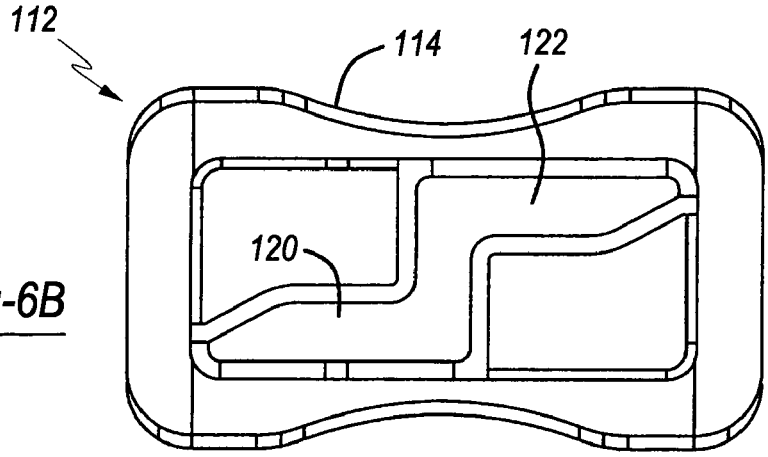
FIG. 6B is a bottom view of the cutter tab illustrated in FIG. 6A and further showing the offset configuration of the track seating portion and in order to permit the cutter tab to translate a partial distance beyond the associated rail.
Figure 6C:
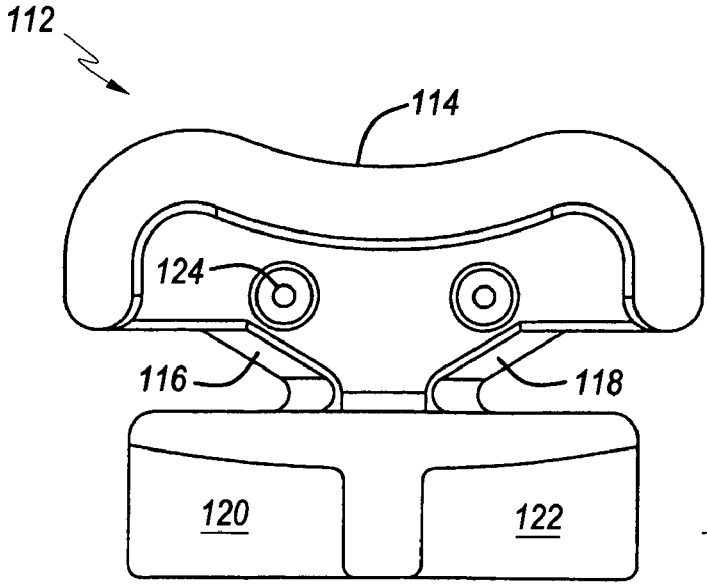
FIG. 6C is a side elevational view of the cutting tab illustrated in FIGS. 6A and 6B.

Referring now to FIGS. 6A–6C, a preferred variation 112 is illustrated of a cutter tab according to the present invention and which was previously alluded to in the above-referenced description of FIG. 6. The cutter tab 112 is similar to that previously illustrated and described at 92 in FIG. 2, and includes such common features as an upper and ergonomically configured gripping portion 114 and a blade (steel, plastic or otherwise) exhibiting oppositely angled and cutting edges 116 and 118. In the preferred embodiment, a stainless steel blade is molded into a plastic holder and is configured so as to be symmetrical about a vertical centerline, enabling it to cut in both traversable directions.

Of note, the preferred embodiment of the cutter tab 112 further includes a lower track seating portion having first 120 and second 122 angularly offset portions. The purpose of the offset portions 120 and 122, as previously described, is to facilitate the translation of the cutter tab 112 a partial distance beyond an edge of an associated rail (not shown) and to ensure complete sectioning of a length of wrap material. Additionally, the configuration of the offsetting portions 120 and 122 is such that the overall length of the box enclosure can be minimized and further that, upon sliding the tab into the rail 82 extrusion with top extending slot 86, the cutting tab is securely captured into the assembly. Reference is further made to the illustrations of FIGS. 1A and 1B which present a first overall and second enlarged end perspective of a slide cutter assembly according to a further preferred embodiment and by which a selected offset seating portion (120 or 122) is permitted to extend a selected distance beyond an associated end of the rail support 82 and selected end stop (46 or 48).

As also illustrated in FIG. 6C, rivets 124 can be formed in the sides of the cutter tab 112 and in order to secure the blade (see edges 116 and 118) in place. A thermal riveting process, as well as any type of mechanical riveting process, may be employed for securing the blade within the tab assembly.

Figure 7:
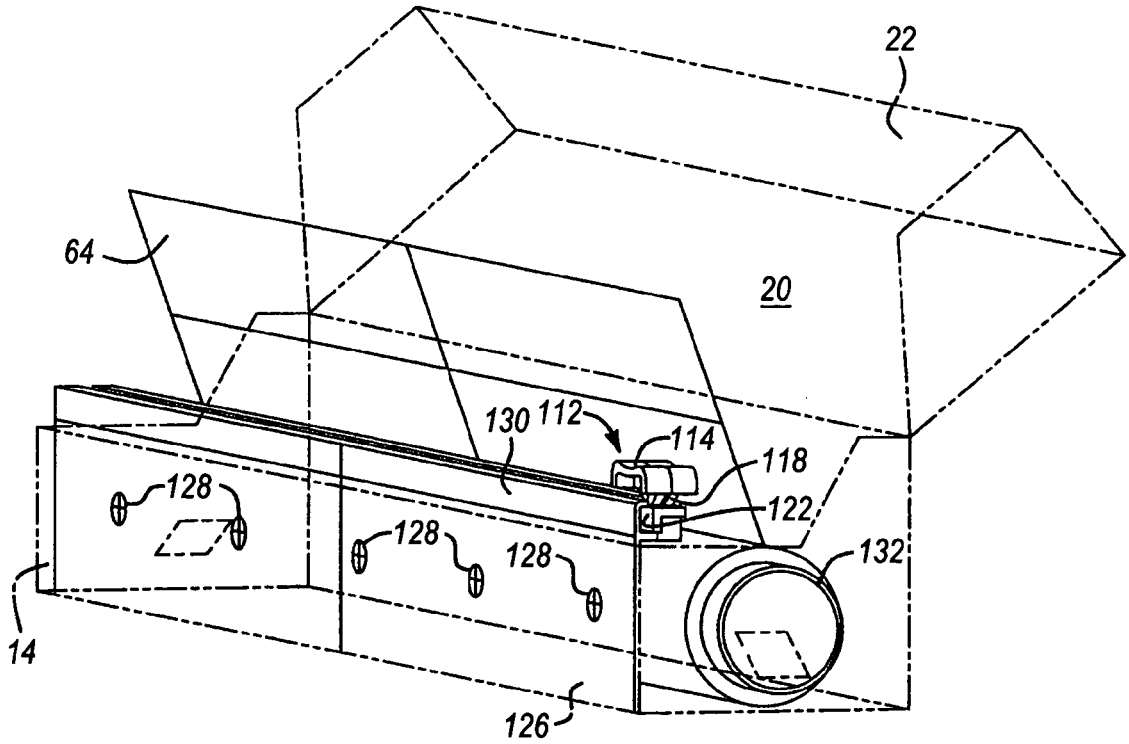
FIG. 7 is a perspective view of a combination rail and cutting tab arrangement mounted directly to such as a wall of a cardboard roll supporting container.
Figure 8:
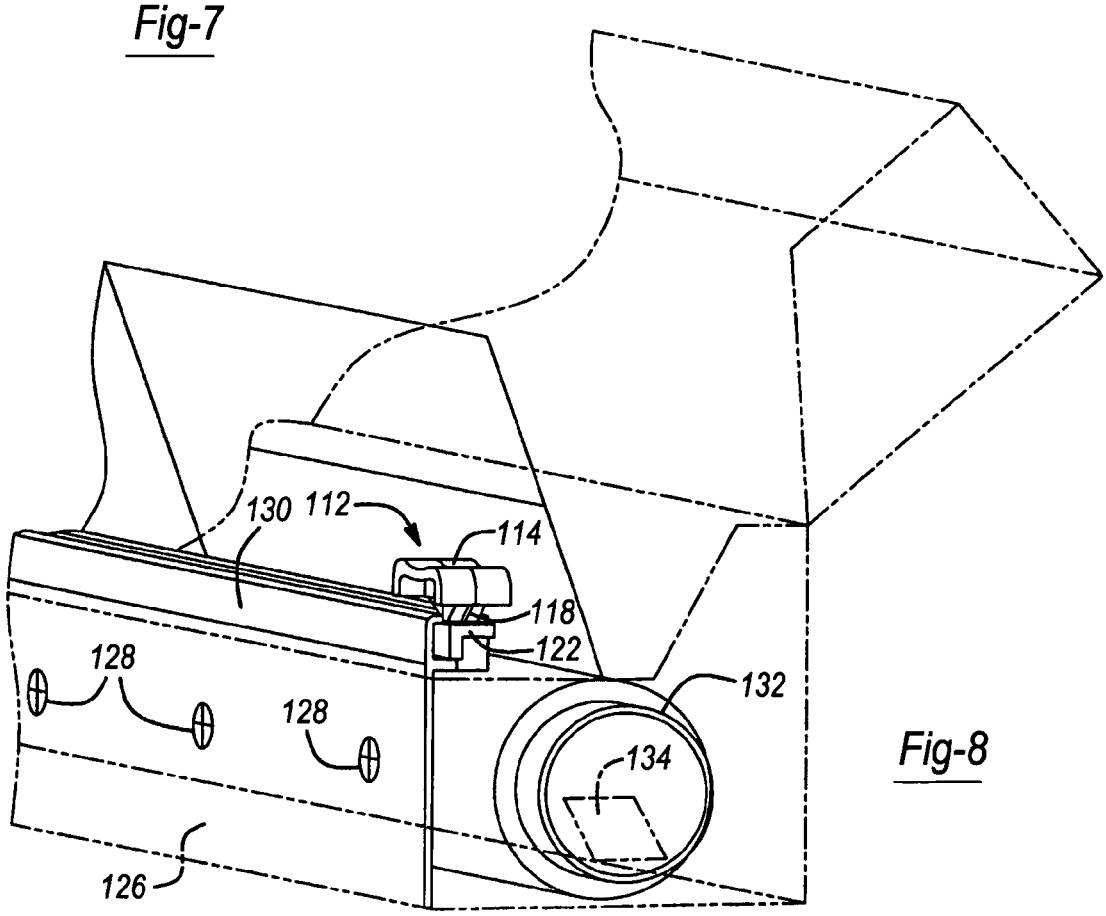
FIG. 8 is an enlarged end perspective of the arrangement illustrated in FIG. 7 and again showing the ability of the cutter tab with offset track seating portions to displace a preselected distance beyond the associated end of a rail support.
Figure 9:
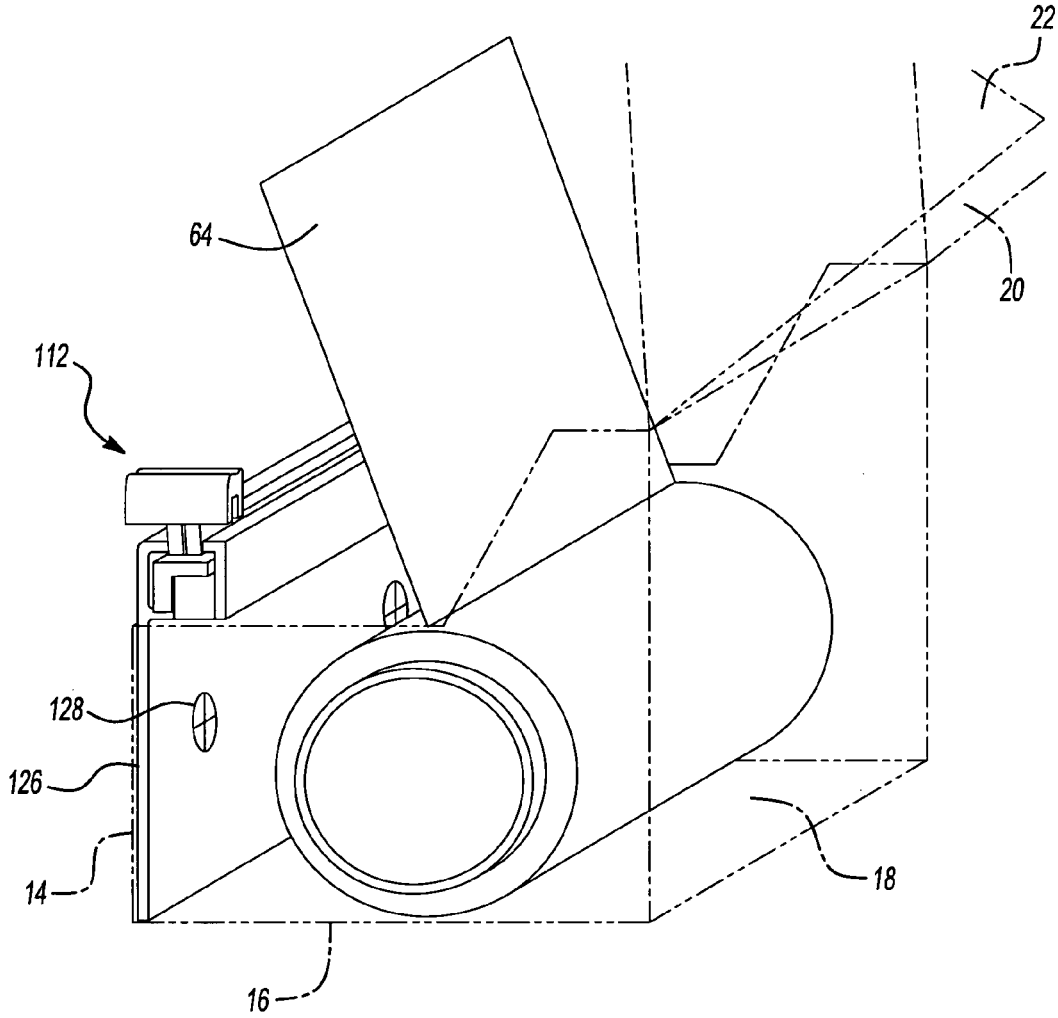
FIG. 9 is a rotated perspective illustration, showing a roll supporting carton container in phantom, and again illustrating the combination rail and cutting tab according to the embodiment of FIG. 7

Referring now to FIGS. 7–9, a series of rotated perspective views are shown of a combination rail and cuffing tab arrangement mounted directly to a wall of a roll supporting container, such as again may be formed of a cardboard or other suitable material. FIG. 7 illustrates a first perspective view of a combination rail and cutting tab arrangement mounted directly to such as the wall of a cardboard roll supporting container 13 and such has been previously substantially described and illustrated in FIG. 1A.

In particular, an extruded, and typically planar shaped, member is illustrated at 126 and is attached, such as directly to an inside surface of a front side 14 of the cardboard box in, one preferred arrangement, by a plurality of rivets 128. It is also understood that the member can alternatively be attached by such as gluing, stapling, or otherwise affixing to the box front.

As is also illustrated in the enlarged perspective of FIG. 8, again shown is the cutter tab assembly 112 as described in FIGS. 6A–6C. Upon being mounted within a rail portion 130 forming a top extending edge of the extrusion 126, the cutter tab 112 with offset track seating portions 120 and 122 displaces a preselected distance beyond the associated end of the rail portion 130. Although not further illustrated, it is understood that a stop is added to each end of the top rail portion 130 and in order to maintain the tab in place.

Also illustrated in phantom in FIGS. 7 and 8 is one of two roll supporting portions, see at 132, which are formed into the sides of the carton and which assist in positionally and rotatably securing the roll of wrap material for selective unreeling and sectioning. It is further understood that the roll supporting portions can be provided as push-in tabs (see further at 134) which maintain the roll sufficiently in place. Although further not shown, it is also understood that the carton design of FIGS. 7–9 can include the top extending shelf or ledge with contoured edge surfaces (see such as at 32 and 33 in FIG. 1) and it is desired that the roll of material is held in a direction toward the rear of the container in order to prevent the roll from repositioning under the slide cutter or top extending shelf.

Having described the presently preferred embodiments, it is to be understood that alternative embodiments may be incorporated without deviating from the scope of the appended claims. In particular, the shaping of the blade assembly 32 may be altered to any desired configuration and may further contemplate the incorporation of a designer button or the like.

As also previously described, the assembly can be constructed so that it is capable of being shipped in a substantially flattened configuration, through the use of the living hinges, and such as is further loaded into an existing carton packaging and along with the roll of wrap material. It is also envisioned that the assembly can be constructed as multiple components according to any type of manufacturing, e.g., extrusion molding, etc.

It is also contemplated that the slide cutter assembly can be constructed integrally with the box carton, within which the roll of wrap material is held. Such a configuration may further include the provision of the cutter tab and rail incorporated into a wall of the box, and combined with the provision of the roll supporting supports built directly into the sides of the box.

The invention claimed is:

1. A slide cutter assembly for use in sectioning lengths of a flexible material drawn from a roll, the roll including a core having oppositely open ends, said assembly comprising:

an elongated body;

a first roll supporting portion located at a first end of said body and a second roll supporting portion located at a second end, the oppositely open ends of the roll being securable by said first and second roll supporting portions in order to rotatably secure the roll to the elongated body where the first and second roll supporting portions each comprise living hinges and are integrally formed with the elongated body; and a cutter tab assembly mounted to a lengthwise extending surface associated with said elongated body, said cutter tab assembly incorporating a traversable blade that is manually operable for sectioning from the roll an unwound length of flexible material and a first gripping portion and a second track seating portion traversably supported within a rail associated with said elongated body, where the blade is traversable in both lengthwise directions to cut flexible material from the packaging roll, wherein said elongated body, said roll supporting portions and said cutter tab assembly form an integral unit that is useable alone, whereby the roll is substantially entirely exposed, and is useable as an insert within a generally elongated and three-dimensional shaped packaging.

2. The slide cutter assembly as described in claim 1, said track seating portion further comprising first and second offset portions for facilitating traversing of said blade a selected distance beyond an end of said rail, said first gripping portion being ergonomically configured, and where the cutter tab assembly includes a blade having oppositely angled edges.

3. The slide cutter assembly as described in claim 1, said rail further comprising an elongated and extruded plastic material exhibiting an interior channel for receiving said track seating portion of the cutter tab assembly in traversable fashion.

4. The slide cutter assembly as described in claim 3, said rail further comprising first and second downwardly extending and elongated gripping portions, said elongated body further comprising at least one projecting snap portion over which said gripping portions are biasingly engaged.

5. The slide cutter assembly as described in claim 4, further comprising first and second rail side supports secured atop said elongated body, said supports terminating in first and second end stops which, upon engagement of said rail, define abutting end locations of said cutter tab assembly.

6. The slide cutter assembly as described in claim 1, said elongated body further comprising a planar shaped and elongated support ledge upon which is supported an unwound portion of the flexible material.

7. The slide cutter assembly as described in claim 1, further comprising a generally elongated and three dimensional shaped packaging.

8. A slide cutter assembly for use in sectioning lengths of a flexible material drawn from a roll, the roll including a core having oppositely open ends, said assembly comprising:

an elongated body;

a first roll supporting portion located at a first end of said body and a second roll supporting portion located at a second end, the oppositely open ends of the roll being securable by said first and second roll supporting portions in order to rotatably secure the roll to the elongated body, each of said first and second roll supporting portions being integrally formed with said elongated body and being hingedly movable relative thereto by a living hinge; and a cutter tab assembly mounted to a lengthwise extending surface associated with said elongated body, said cutter tab assembly incorporating a traversable blade that is manually operable for sectioning from the roll an unwound length of flexible material, wherein said elongated body, said roll supporting portions and said cutter tab assembly form an integral unit that is useable alone, whereby the roll is substantially entirely exposed, and is useable as an insert within a generally elongated and three-dimensional shaped packaging.

9. The slide cutter assembly as described in claim 8, said cutter tab assembly further incorporating a first gripping portion and a second track seating portion traversably supported within a rail associated with said elongated body, where the blade is traversable in both lengthwise directions to cut flexible material from the packaging roll said gripping portion being ergonomically configured, and where the cutter tab assembly includes a blade having oppositely angled edges.

10. The slide cutter assembly as described in claim 9, said track seating portion further comprising first and second offset portions for facilitating traversing of said blade a selected distance beyond an end of said rail.

11. The slide cutter assembly as described in claim 9, said rail further comprising an elongated and extruded plastic material exhibiting an interior channel for receiving said track seating portion of the cutter tab assembly in traversable fashion.

12. The slide cutter assembly as described in claim 11, said rail further comprising first and second downwardly extending and elongated gripping portions, said elongated body further comprising at least one projecting snap portion over which said gripping portions are biasingly engaged.

13. The slide cutter assembly as described in claim 8, said elongated body further comprising a planar shaped and elongated support ledge upon which is supported an unwound portion of the flexible material.

14. A slide cutter assembly for use in sectioning lengths of a film wrap material drawn from a packaging roll, the roll including a core having oppositely open ends, said assembly comprising:

an elongated body having a first end and a second end, a planar shaped and elongated support ledge being defined along an upper surface of said body;

a first roll supporting portion located at a first end of said body and a second roll supporting portion located at a second end, said roll supporting portions each further comprising living hinges for permitting said supporting portions to be pivoted into opposingly engaging contact with the oppositely open ends of the film roll core in order to rotatably secure the packaging roll to the elongated body; and a cutter tab assembly mounted to a lengthwise extending surface associated with said elongated body, said cutter tab assembly incorporating a traversable blade seated within an elongated rail secured upon said elongated body, said traversable blade being manually operable for sectioning from the packaging roll an unwound length of film wrap material, wherein said elongated body, said roll supporting portions and said cutter tab assembly form an integral unit that is useable alone, whereby the roll is substantially entirely exposed, and is useable as an insert within a generally elongated and three-dimensional shaped packaging.

15. A slide cutter assembly for use in sectioning lengths of a flexible material drawn from a roll, the roll including a core having oppositely open ends, said assembly comprising:

an elongated body;

a first roll supporting portion located at a first end of said body and a second roll supporting portion located at a second end, each of said roll supporting portions further comprising a living hinge and a planar portion from which projects a circular cross sectional shaped core support portion, each core support portion for respectively seating within the oppositely open ends of the roll core in order to rotatably secure the roll to the elongated body; and a cutter tab assembly mounted to a lengthwise extending surface associated with said elongated body, said cutter tab assembly incorporating a traversable blade and associated rail portion, said traversable blade being manually operable for sectioning from the roll an unwound length of the flexible material, wherein said elongated body, said roll supporting portions and said cutter tab assembly form an integral unit that is useable alone, whereby the roll is substantially entirely exposed, and is useable as an insert within a generally elongated and three-dimensional shaped packaging.

16. The slide cutter assembly as described in claim 15, said cutter assembly further comprising first and second offset track seating portions for facilitating translation of said blade a selected distance beyond an associated extending edge of said rail portion.

* * * * *